US006517357B1

(12) United States Patent
Athanasiou et al.

(10) Patent No.: US 6,517,357 B1
(45) Date of Patent: Feb. 11, 2003

(54) SLIP RING AND BRUSH ASSEMBLY FOR USE IN A VIDEO RECORDER

(75) Inventors: George Athanasiou, Burlingame, CA (US); Constantine Athanasiou, South San Francisco, CA (US)

(73) Assignee: Athan Corporation, South San Francisco, CA (US)

( * ) Notice: Subject to any disclaimer, the term of this patent is extended or adjusted under 35 U.S.C. 154(b) by 44 days.

(21) Appl. No.: 09/721,436

(22) Filed: Nov. 22, 2000

(51) Int. Cl.[7] ..... H01R 39/00

(52) U.S. Cl. ..... 439/26

(58) Field of Search ..... 439/26, 23, 24, 439/25

(56) References Cited

U.S. PATENT DOCUMENTS

| | | | | | |
|---|---|---|---|---|---|
| 3,601,747 | A | * | 8/1971 | Prall et al. | 439/26 |
| 3,988,049 | A | * | 10/1976 | Williams et al. | 310/71 |
| 4,398,113 | A | | 8/1983 | Lewis et al. | |
| 4,850,880 | A | * | 7/1989 | Zayat et al. | 379/437 |
| 5,409,403 | A | * | 4/1995 | Falossi et al. | 439/21 |
| 5,865,629 | A | * | 2/1999 | Bernardini | 439/26 |
| 6,089,875 | A | * | 7/2000 | Iwata et al. | 439/23 |

OTHER PUBLICATIONS

"High Speed Slip Ring Capsule", Litton Systems, Inc. Website http://www.litton–ps.com/SlipRings/ec3848.html, download Sep. 27, 2000.

* cited by examiner

*Primary Examiner*—Neil Abrams
*Assistant Examiner*—Phuong K T Dinh
(74) *Attorney, Agent, or Firm*—Beyer Weaver & Thomas, LLP

(57) ABSTRACT

A slip ring and brush assembly for transmitting electrical energy between a stationary conductor and a rotating head assembly of a video recording device is disclosed. The assembly includes a rotor having a base and a shaft. The base is arranged to couple with a rotatable spindle located in a drum assembly of a video tape recorder. The base includes a conductive contact pad for electrically engaging a plurality of electrically conductive leads disposed on the rotatable spindle and electrically coupled to the rotating head assembly. The shaft extends from the base and includes an electrically conductive slip ring positioned on the shaft. The electrically conductive slip ring is electrically coupled to the electrically conductive contact pad. The assembly further includes a stator that is rotatably coupled to the rotor. The stator includes a pedestal and a sheath. The assembly also includes a brush holder, which is mounted to the pedestal. The brush holder is configured to hold a fiber brush in biased contact with the slip ring. The fiber brush is electrically coupled to the stationary conductor, and includes a plurality of electrically conductive fibers that are grouped together to form a single fiber brush.

21 Claims, 4 Drawing Sheets

SLIP RING AND BRUSH ASSEMBLY FOR USE IN A VIDEO RECORDER

BACKGROUND OF THE INVENTION

The present invention relates to video tape recorders. More particularly, the present invention relates to improved slip ring and brush assemblies for transmitting electrical signals and power across a rotating interface in a video tape recorder.

Video tape recorders employ rotating record/reproduce head assemblies. In such recorders, tape which is used as the recording medium is wrapped partially around a drum having a rotating record/reproduce head assembly. In general, the head assembly is connected to a rotatable spindle inside the drum. During the data recording or reproducing process, the tape is moved (or held stationary) while the recording or reproducing is accomplished, i.e., as the recording/reproducing head(s) rotates with the spindle. By way of example, representative video tape recorders utilizing record/reproduce head assemblies may include models DVW, DNW, HDW Series manufactured by Sony Corporation.

In such video tape recorders, electrical signals, as well as electrical power signals, must be transmitted to and from the rotating head assembly. Accordingly, slip ring and brush assemblies have been introduced and employed to various degrees to carry electrical signals between the rotating heads and other equipment with which the rotating head has relative motion. Slip ring and brush assemblies are typically used in electromechanical systems that require unrestrained, continuous rotation while transmitting power and/or electrical signals from a stationary conductor to a rotating structure. In general, slip ring assemblies include a rotor, which is a rotating part, and a stator, which is a stationary part about which the rotor turns. Brush assemblies typically include a brush holder and a brush, both of which are stationary. More particularly, the rotor generally comprises a rotating conductive ring, which is contacted by a non-rotating conductive brush.

To facilitate discussion, FIGS. 1A–1C illustrate an exemplary prior art slip ring and brush system 10 used in video recording devices. FIG. 1A is a side elevation view, in cross section, of the system 10, FIG. 1B is a cut away top view of the system 10, and FIG. 1C is a bottom view of the system 10. As shown, the slip ring assembly 10 includes a rotor 12 and a stator 14. The rotor 12 includes a base 16 and a shaft 18. The base 16 is configured for mating with a drum assembly of the video recorder (not shown) and the shaft 18 is configured for carrying a plurality of slip rings 20. As shown in FIG. 1A, the bottom of the base 16 includes a protrusion 22, which physically engages a spindle of the drum assembly. The bottom of the base 16 also includes mounting posts 24, which couple the system 10 to the spindle (e.g., with machine screws). Still further, the bottom of the base 16 includes a bottom surface 26 having a plurality of contact pads 28 disposed thereon (shown in FIG. 1C). The contact pads 28 are separately and electrically connected to the slip rings 20 carried by the shaft 18. The contact pads 28 are for engaging contact pins that are electrically coupled to a head assembly disposed inside the drum assembly.

With regard to the stator 14, the stator 14 includes a support member 30 that is rotatably mounted onto the shaft 18 with a first set of bearings 32 positioned at an upper portion of the shaft 18, and a second set of bearings 34 positioned at a lower portion of the shaft 18. As shown, the slip rings 20 are disposed between each of the set of bearings 32, 34. The stator 14 also includes a first brush assembly 36 positioned to a first side of the shaft 18, and a second brush assembly 38 positioned to a second side of the shaft 18. The second side is opposite the first side. Both of the brush assemblies 36, 38 are mounted to the support member 30 and each brush assembly includes a brush holder 39 and a plurality of single filament brushes 40 for electrically contacting the slip rings 20. Furthermore, each of the single filament brushes 40 is coupled to a transport ribbon cable 42, which is arranged for carrying electrical signals and/or power to and from an external device such as a printed circuit board. Moreover, a rectangular cover 44 is typically disposed over the stator/rotor combination.

Unfortunately, the design and implementation of the above assembly leads to problems which may shorten part life and the proper functioning of the video recording device in which it is used. One problem associated with the above assembly is that excessive vibrations may be encountered during rotation of the rotor about the stator. Excessive vibrations may be formed by an improperly mated or misaligned connection (e.g., un-balanced) at the rotor/spindle interface. For example, if the protrusion is too small then the rotor may wobble during rotation. Excessive vibrations tend to cause increased bearing wear, and may even cause the bearings to stiffen or seize Stiffened bearings may impede the rotation of the rotor or may induce more vibration. Excessive vibrations may also reduce contact between the brushes and the slip rings. Furthermore, the type of ball bearings used and the placement of the ball bearings on the rotating shaft may exacerbate the vibration problem.

Another problem with the above assembly 10 is that each of the brushes 40 is a monolithic or mono-filament member having a rectangular or cylindrical cross-section. Although the surface of the brush 40 is in contact with the rotating slip ring 20, irregularities in the ring surface and uneven wear properties of the brush limit contact between the brush 40 and the ring 20 to only a few discrete points. These discrete points of contact between the brush 40 and the slip ring 20 cause the brush biasing force to be concentrated on these few points. This concentration of force results in localized high pressures on these few points and this leads to unexpected wear of both the brush and ring surface. Furthermore, the resultant wear debris may increase electrical resistance to the flow path of electricity through the assembly or may contaminate portions of the video recorder, for example, the head assembly found beneath the assembly.

Other problems associated with the above slip ring and brush assembly include a double brush assembly, which increases complexity and costs, a slip ring assembly that is not fully enclosed (e.g., open space 46) and therefore may lead to contamination of both the assembly 10 and any components found beneath the assembly 10 (e.g., video recorder), and contact pads 28 that are thinly plated and thus may easily wear. By way of example, the contact pads 28 are typically formed from gold plated copper elements.

Thus, there is a need for improved slip assemblies for transmitting electrical signals and power across a rotating interface in a video tape recorder.

SUMMARY OF THE INVENTION

The invention relates, in one embodiment, to a slip ring assembly for use in a video recording device. The slip ring assembly includes a base for coupling with a rotatable spindle located in a drum assembly of a video tape recorder.

The base includes a plurality of electrically conductive contact pads for electrically engaging a plurality of electrically conductive leads disposed on the rotatable spindle and electrically coupled to a record/reproduce head assembly. The slip ring assembly further includes a shaft having a first portion coupled to the base and a second portion extending longitudinally from the first portion. The slip ring assembly additionally includes a plurality of electrically conductive slip rings positioned on the second portion of the shaft, where each slip ring is separated by an insulating medium and electrically coupled to an individual one of the plurality of contact pads. The slip ring assembly also includes a pedestal rotatably supported on the first portion of the shaft.

In some embodiments, a brush assembly for transmitting electrical energy between a plurality of stationary conductors and the plurality of slip rings is provided. The brush assembly includes a plurality of fiber brushes for electrically contacting individual ones of the plurality of slip rings. Each of the fiber brushes includes a plurality of fibers that are maintained in a bundle.

The invention relates, in another embodiment, to a slip ring and brush assembly for transmitting electrical energy between a stationary conductor and a rotating head assembly of a video recording device. The slip ring and brush assembly includes a rotor having a base and a shaft. The base is arranged to couple with a rotatable spindle located in a drum assembly of a video tape recorder. The base includes a conductive contact pad for electrically engaging a plurality of electrically conductive leads disposed on the rotatable spindle and electrically coupled to the rotating head assembly. The shaft extends from the base and includes an electrically conductive slip ring positioned on the shaft. The electrically conductive slip ring is electrically coupled to the electrically conductive contact pad. The slip ring and brush assembly further includes a stator that is rotatably coupled to the rotor. The stator includes a pedestal and a sheath. The slip ring and brush assembly also includes a brush holder, which is mounted to the pedestal. The brush holder is configured to hold a fiber brush in biased contact with the slip ring. The fiber brush is electrically coupled to the stationary conductor, and includes a plurality of electrically conductive fibers that are grouped together to form a single fiber brush.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE INVENTION

Figure 1A:
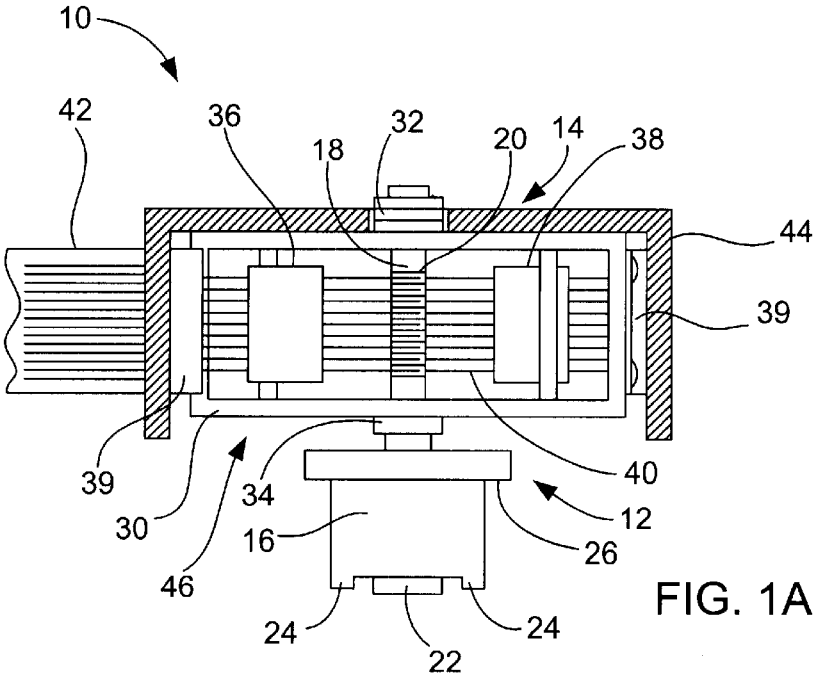
FIGS. 1A–C are side, top and bottom views, respectively, of a prior art slip ring and brush assembly.
Figure 1B:
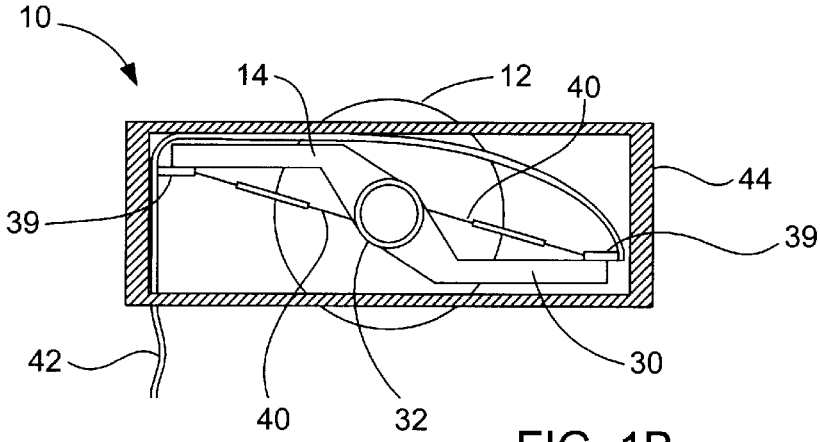
Figure 1C:
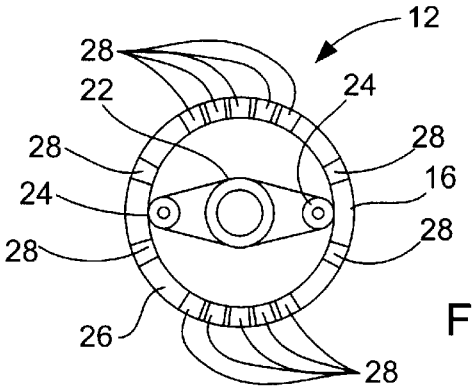
(PRIOR ART) FIG. 1C

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order not to unnecessarily obscure the present invention.

The invention pertains to an improved slip ring and brush assembly for transmitting electrical signals and power across a rotating interface in a video tape recorder. One aspect of the invention relates to improving rotation of the rotor relative to the stator so as to produce high rpm's, while reducing vibration and wear. For example, multiple fiber brushes as well as a bearing assembly can be used to provide long life and high rpm's. Another aspect of the invention relates to improving conductive contact so as to produce better power and signal transmissions through the slip ring and brush assemblies. For example, in one embodiment solid metal slip rings (e.g., gold) and multiple fiber brushes can be used to provide improved conductive contact between the slip ring and brushes. In addition, solid metal contacts (e.g., gold) can be used in certain embodiments to provide improved conductive contact between the contacts and the head assemblies.

In accordance with one embodiment of the present invention, there is provided a slip ring and brush assembly for use in a video tape recorder. The assembly provides life and rpm's that meet or exceed the requirements for most video tape recorders. The slip ring assembly generally includes a rotor and a stator. The rotor arrangement includes a base for coupling with a rotatable spindle located in a drum of a video tape recorder. A plurality of electrically conductive contact pads are generally disposed on a surface of the base for electrically engaging a plurality of electrically conductive leads, which are electrically coupled to a head assembly disposed in the drum. The rotor also includes a shaft extending from the base and a plurality of electrically conductive slip rings positioned on the shaft. Each slip ring is separated by an insulating medium and electrically coupled to an individual one of the plurality of contact pads. The stator arrangement includes a housing rotatably supported on the shaft between the base and the slip rings. In most embodiments, a bearing assembly is used to rotatably couple the housing to the shaft. The housing generally provides a structure to mount a brush holder and a sheath. The brush holder generally includes a plurality of fiber brushes, each having a plurality of electrically conductive fibers that are grouped together to form a single brush. The fiber brushes are arranged to be in biased contact with individual ones of the plurality of slip rings when the brush holder is mounted to the housing. Moreover, the sheath is used to enclose the slip rings and fiber brushes so as to prevent contamination.

Embodiments of the invention are discussed below with reference to FIGS. 1–7. However, those skilled in the art will readily appreciate that the detailed description given herein with respect to these figures is for explanatory purposes as the invention extends beyond these limited embodiments.

Figure 2:
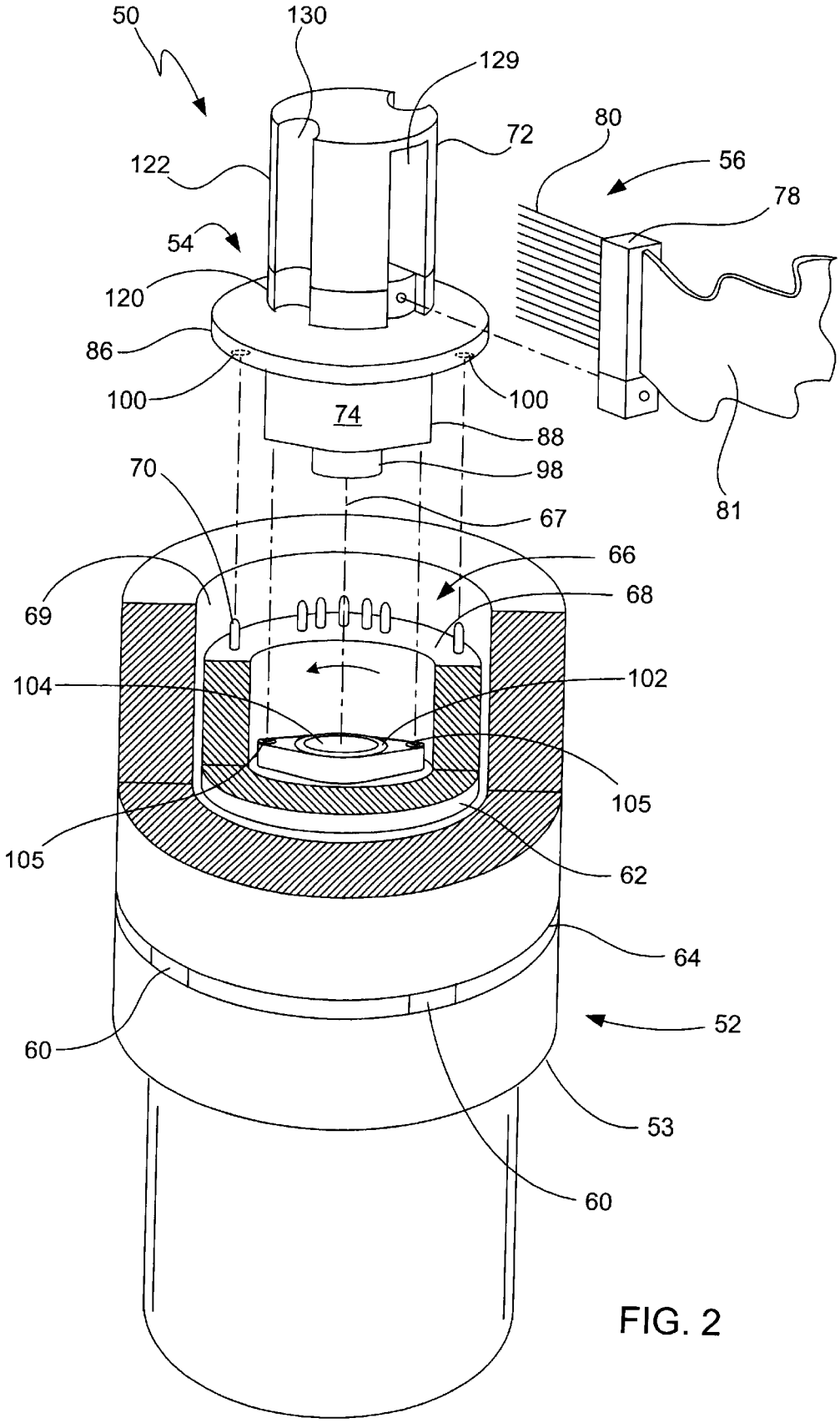
FIG. 2 is a perspective diagram of a scanner system, in accordance with one embodiment of the present invention.

FIG. 2 is a perspective diagram of a scanner system 50, in accordance with one embodiment of the present invention. The scanner system 50 includes a drum assembly 52, a slip ring assembly 54 and a brush assembly 56. The drum assembly 52 (cut away for ease of discussion) includes a drum 53 for housing a rotating record/reproduce head assembly. The head assembly, among other things, includes a plurality of heads 60 coupled to a rotatable spindle 62. The plurality of heads 60 are configured for video recording, and disposed within a channel 64 located along the periphery of the drum assembly 52. The rotatable spindle 62 is rotatably coupled within a cavity 66 located inside the drum assembly 52. In most cases, the spindle 62 is connected to a motor (not shown) for rotating the spindle 62 along a drum axis 67 at speeds up to 10,000 revolutions per minute (rpm). In one implementation, the speed is about 5,800 rpm. As should be appreciated, during a recording or reproducing process, a tape (e.g., magnetic) is positioned along the outer peripheral surface of the drum 53 adjacent the recording/reproducing heads, and the recording/reproducing heads 60 are rotated via the spindle 62 to accomplish any recording or reproducing tasks. Moreover, a top portion of the spindle 62 forms a rotating interface 68 that includes a plurality of conductive contact pins 70 for transmitting electrical signals to and from the head assembly. Although not shown, the contact pins 70 are generally spring biased in a direction towards the slip ring assembly 54.

In accordance with the invention, the slip ring assembly 54 and the brush assembly 56 are provided to transmit electrical signals and power across the rotating interface 68 and through the contact pins 70 to the head assembly. The slip ring assembly 54 generally includes a stator 72 and a rotor 74, and the brush assembly generally includes a brush holder 78 and a plurality of brushes 80. As shown, the rotor 74, which is rotatable relative to the stator 72, is adapted to securely couple with the spindle 62 of the drum assembly 52, and the brush holder 78, which is stationary, is adapted to securely couple with the stator 72 of the slip ring assembly 54. When coupled together, a first portion of the rotor 74 is arranged to electrically engage the rotating interface 68, i.e., the conductive pins 70, and a second potion of the rotor 74 is arranged to electrically engage the plurality of brushes 80. Accordingly, the slip ring 54 assembly and the brush assembly 56 provide an electrical path from the head assembly to a transport cable 81 (e.g., ribbon cable), which is electrically attached to the plurality of brushes 80, and which can be connected to an external device such as a printed circuit board or power supply (not shown).

Figure 4:
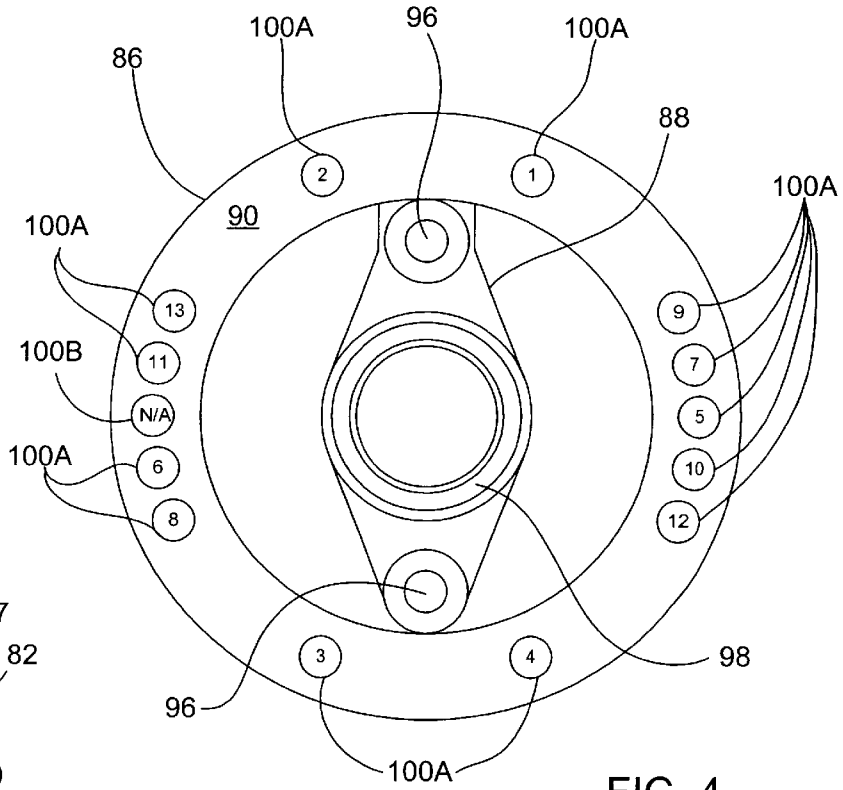
FIG. 4 is a bottom view of a base of the slip ring assembly shown in FIG. 3, in accordance with one embodiment of the present invention.
Figure 3:
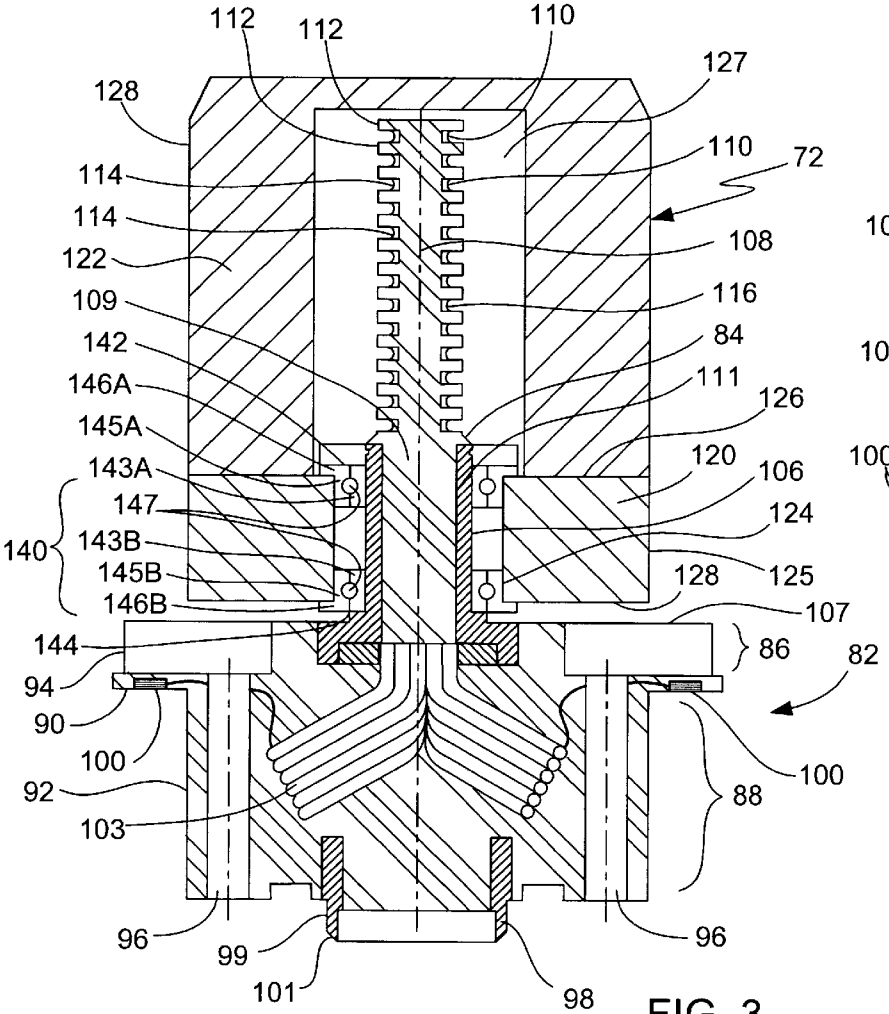
FIG. 3 is a side elevation view, in cross section, of a slip ring assembly, in accordance with one embodiment of the present invention.

Referring to FIGS. 2–4, the slip ring assembly 54 will be described in greater detail. As mentioned, the slip ring assembly 54 includes a rotor 74, which rotates in unison with the spindle 62 of the drum assembly 52, and a stator 72, which structurally supports the brush assembly 56. In general, the rotor 74 includes a base 82 and a shaft 84 that extends longitudinally from the base 82. The base 82 is arranged for physically coupling with the spindle and electrically coupling with the rotating interface 68. The shaft 84, on the other hand, is arranged for physically coupling with stator 72 and electrically coupling with the plurality of brushes 80.

With regards to the base 82, the base 82 includes an upper mounting portion 86 and a lower mounting portion 88. As shown, the lower mounting portion 88 has an outer periphery 92 that is smaller than an outer periphery 94 of the upper mounting portion 86. In general, the upper mounting portion 86 is configured to electrically engage the contact pins 70, while the lower mounting portion 88 is configured to physically engage the spindle 62.

Referring first to the lower mounting portion 88, the lower mounting portion 88 is configured to mate with the spindle 62 so as to couple the slip ring assembly 54 to the drum assembly 52. As such, the lower mounting portion 88 includes a plurality of mounting posts 96 and an extended neck 98. The extended neck 98, which extends distally farther than the mounting posts 96, is configured to align the base 82 with the spindle 62 and to concentrically support the base 82 relative to the spindle 62. As shown, the axis of the extended neck 98 is aligned with the axis of the spindle 62, i.e., drum axis 67. More particularly, an outer periphery 99 of the extended neck 98 is generally configured for placement within a guide 102 (FIG. 2) that is axially positioned on the spindle 62 such that an inner periphery 104 of the guide 102 securely surrounds the outer periphery 99 of the extended neck 98. In the embodiment shown, both the guide 102 and the extended neck 98 are cylindrical in shape. As should be appreciated, a cylindrical shape tends to provide increased balance when rotating. It should be noted, however, that this is not a limitation and that the shape may vary according to the specific design of each device.

In general, the greater the touching surface between the neck 98 and the guide 102, the greater the concentric support. As such, a large neck length is provided to concentrically support and balance the base 82 relative to the spindle 62. In one embodiment, the extended neck 98 is configured with a minimum length of about ⅛ inches. It has been found that this type of support and balance substantially reduces vibration and wear. For example, this type of support tends to overcome reduced touching surfaces caused by a counter bored guide. It should be noted, however, that the length may vary as long as the length provides a touching surface that concentrically supports the neck relative to the guide. The extended neck 98 is generally formed from a rigid material such as stainless steel or brass and press fitted into the lower mounting portion 88. In some embodiments, the extended neck 98 may include a taper 101 to make it easier to install into the guide 102. In one implementation, the taper 101 is angled at about 45 degrees.

Moreover, the mounting posts 96 are configured to help secure the base 82 to the spindle 62. The mounting posts 96 generally have openings for placing a bolt or screw therethrough and the spindle 62 generally has a threaded portion 105 (FIG. 2) for securely receiving the bolt or screw. As shown in FIG. 4, the mounting posts 96 and the extended neck 98 form a diamond shape with the mounting posts 96 forming the two acute points of the diamond and the extended neck 98 forming the middle of the diamond. It should be appreciated, however, that this is not a limitation and that the shape, including the mounting posts and neck may vary according to the specific needs of each device.

Referring now to the upper mounting portion 86, the outer periphery 94 of the upper mounting portion 86 is generally configured for placement within the cavity 66 of the drum assembly 52 such that an inner periphery 69 of the cavity 66 surrounds the outer periphery 94 of the upper mounting portion 86. A clearance between surfaces 69 and 94 is generally provided to maintain proper rotation without impediments. Furthermore, the bottom surface 90 of the upper mounting portion 86 includes a plurality of electrically conductive contact pads 100 disposed thereon, which are configured for electrically engaging the contact pins 70 of the head assembly when the base 82 is coupled to the spindle 62. As shown in FIG. 4, the contact pads 100 are circular and generally formed from a solid conductive material. It has been found that circular pads are easier to manufacture. In one implementation, solid gold contact pads are used. It is generally believed that solid gold contacts offer the advantage of greater wear resistance. It should also be noted that the shape of the contact pads may vary according to the specific design of each device.

In one embodiment, the placement of the contact pads 100 are configured to provide balanced rotation so as to reduce vibration. As should be appreciated, the closer to perfectly balanced the better. In the embodiment shown, an even number of contact pads 100 are positioned around the perimeter of the bottom surface 90 so that individual contact pads are placed opposite one another. For example, contact pad 1 is positioned opposite contact pad 3.

In some cases, an odd number of contact pads may be needed and therefore dummy pads may be provided for balancing purposes. In accordance with one embodiment, 13 contact pads 100A are used for electrically connecting to the head assembly and 1 dummy pad 100B is used for balancing. It should be appreciated, however, that this is not a limitation and that the number of contact pads and dummy pads may vary according to the specific needs of each device.

Furthermore, the contact pads 100 are generally disposed (or embedded) inside the upper mounting portion 86, and have a bottom surface that is Rush with the bottom surface 90 of the upper mounting portion 86. A plurality of wires 103 disposed (or embedded) in the base 82 are connected to the contact pads 100 so as to provide an electric path through the base 82 to the shaft 84. The wires 103 are generally formed from a suitable conductive material and the base 82 is generally formed from a suitable insulating medium. By way of example, the wires may be formed from copper and the base may be formed from plastic or ceramic. It should be understood, however, that this is not a limitation and that the materials may vary according to the specific needs of each device. For example, insulated wires may be used. Moreover, the base 82, including the upper and lower mounting portions 86, 88, the contact pads 100 and the wires 103, is typically manufactured as a molded assembly.

With regards to the shaft 84, the shaft 84 is structurally coupled to the base 82 and extends longitudinally from a top surface 107 of the base 82. The shaft 84 generally includes a support post 106 and a slip ring post 108 disposed within the support post 106. The support post 106 is configured to structurally support the slip ring post 108 in the axial direction. More particularly, the support post 106 is a cylindrical sleeve having an interior portion 111 configured for securely receiving a cylindrical bottom portion 109 of the slip ring post 108. In most cases, the bottom portion 109 of the slip ring post 108 is press fitted into the interior portion 111 of the support post 106. Moreover, the support post 106 is generally partially embedded in the upper mounting portion 86 of the base 82 and formed from a structural material such as stainless steel. As shown, the support post 106, and thus, the slip ring post are axially aligned with the longitudinal axis of the base 82.

The slip ring post 108 is arranged with a plurality of conductive slip rings 110, which are attached thereto. Each of the slip rings 110 are electrically isolated from one another and longitudinally (vertically) stacked along the slip ring post 108. Although not directly shown, the wires 103, which are coupled to the contact pads 100 and disposed in the base 82, also extend into the slip ring post 108 where they are electrically coupled to the slip rings 110. As such, the wires 103 provide an electric path from the contact pads 100 to the slip rings 110. In most cases, the wires 103 are connected so that individual ones of the contact pads 100 electrically correspond to individual ones of the slip rings 110. In accordance with one embodiment of the invention, 13 contact pads as well as 13 slip rings are used to transmit electrical signals and power to and from the head assembly.

As shown, the slip ring post 108 includes a plurality of circumferential ridges 112 and circumferential grooves 114. Each groove 114 is configured to securely receive the inner surface of one of slip rings 110 such that the inner surface of the slip ring surrounds the outer surface of the groove 114. The ridges 112, which extend away from the longitudinal axis of the slip ring post 108, are configured to electrically separate the conductive slip rings 110. That is, the ridges 112 provide insulating spacers between adjacent slip rings 110. In the embodiment shown, the slip ring post 108 and the ridges 112 thereon are formed form a suitable insulating material such as rubber or plastic. By way of example, polyurethane may be used. The slip rings 110, on the other hand, are formed from a suitable conductive material. In one embodiment, the slip rings 110 are formed from a solid conductive material such as gold.

Figure 7:
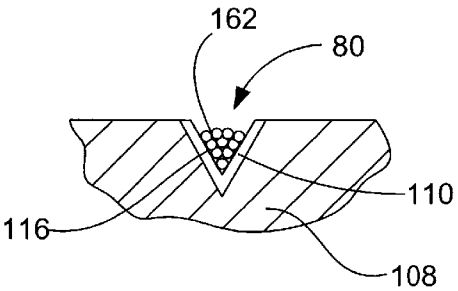
FIG. 7 is a view taken along 7–7' of FIG. 6, in accordance with one embodiment of the present invention.

The plurality of slip rings 110 are arranged to electrically engage and physically receive the plurality of brushes 80 when the brush assembly 58 is mounted to the stator 72. An outer peripheral surface 116 of the slip ring 110, therefore, may be flat or may be formed as a channel (as shown in FIG. 7). Channeled slip rings are generally preferred so as to hold the plurality of brushes 80 in place during slip ring 110 rotation and to further increase brush/slip ring contact. The channels are generally sized so that the outer perimeter of the brushes substantially fill the inner perimeter of the channel. Furthermore, channeled slip rings tend to group multiple filaments brushes 80 together so as to prevent spreading of the filaments across the surface of the slip ring post. Th multi-filament brushes will be described in greater detail below. In the embodiment shown, the outer peripheral surface 116 of the slip ring 110 is a V-shaped channel. However, it should be noted, that this is not a limitation and that the shape of the surface may vary according to the specific needs of each slip ring. By way of example, some other shapes may include rectangularly shaped or U-shaped channels.

Referring now to the stator 72, the stator 72 includes a pedestal 120 and a sheath 122. The pedestal 120 is rotatably coupled to the shaft 84, and more particularly rotatably coupled to the support post 106 of the shaft 84. As should be appreciated, the support post 106 is not only configured for structurally supporting the slip ring post 108, but also for rotatably supporting the pedestal 120. The pedestal 120 is arranged to support the brush assembly 58 so that individual brushes can engage individual slip rings. The sheath 122, on the other hand, is structurally coupled to the pedestal 120. The sheath 122 is arranged to enclose the electrical components of the rotor, i.e., slip ring post, and the brushes of the brush assembly when all the components are attached, i.e., when the brush assembly 58 is attached to the pedestal 120.

The pedestal 120 is a disk shaped or cylindrical element having an outer peripheral surface 125, a top surface 126 and a bottom surface 128. As mentioned, a cylindrical shape tends to provide increased balance when rotating. In the embodiment shown, the pedestal 120 is positioned between the slip rings 110 and the base 82 such that the top surface 126 is disposed below the slip rings 110 and the bottom surface 128 is disposed above the base 82. In addition, the outer peripheral surface 125 is typically smaller than the outer periphery of the upper mounting portion 86 of the base 82. The disk shaped pedestal 120 also includes a central opening 124, which is fitted to the lower portion of the shaft 84 protruding from the base 82 (support post 106). The pedestal 120 is generally formed from a suitable rigid material such as aluminum or plastic.

The sheath 122 is cylindrical cover having an inner cavity 127, outer peripheral surface 128 and a side opening 129. The inner cavity 127 is configured to surround or envelope the slip ring post 108. A clearance is generally provided between the cavity wall and the slip ring post 108 to maintain proper rotation without impediments. The side opening 129 is configured to receive the brush assembly 58 so as to allow the plurality of brushes 80 access to the slip rings 110 positioned on the slip ring post 108. The outer peripheral surface 128 generally h as the same circumference as the pedestal 120. In most cases, the diameter of both the sheath and the pedestal is small to provide clearance for other parts surrounding the scanner system 50. In the illustrated embodiment, the diameter is about 1 inch. It should be noted, however, that the size and shape may vary according to the specific needs of each device.

The sheath 122 is generally formed from a suitable rigid material such as aluminum or plastic. The sheath 122 is typically attached to the pedestal 120 using a plurality of screws or bolts. As such, the sheath 122 generally includes a plurality of openings for allowing the plurality of bolts passage therethrough, and the pedestal 120 includes a plurality of threaded portions for securely receiving the bolts. When assembled, the bottom surface of the sheath 122 mates with the top surface of the pedestal 120. Furthermore, as shown, the pedestal 120 and the sheath 122 have a partial circular channel 130 formed in their outer peripheral surface so as to allow access for bolts when connecting the base 82 to the spindle 62.

To elaborate further, the pedestal 120 is rotatably fixed to the shaft 84 with a bearing assembly 140. The bearing assembly 140 is a support and guide mechanism for carrying the rotor 74 and maintaining the proper relationship between the rotor 74 and the stator 72. In essence, the bearing assembly 140 permits rotor rotation while preventing other types of rotor movement relative to the stator 72. In the embodiment shown, the bearing assembly 140 generally includes a first bearing unit 142 and a second bearing unit 144. Each of the bearing units 142, 144 includes an inner ring 143, an outer ring 145 and a bearing 147 disposed therebetween. By way of example, the bearing may take the form of a ball bearing or a roller bearing. Furthermore, each of the bearing units, including the inner ring 143 and the outer ring 145, are configured to extend through the central opening 124 of the pedestal 120 and surround the shaft 84. For ease of discussion, the inner and outer ring associated with the first bearing unit 142 is designated with an "A"and the inner and outer ring associated with the second bearing unit is designated with a "B."

To elaborate further, the inner ring 143A is fixed to an upper portion of the support post 106 and the outer ring 145A is fixed to an upper portion of the pedestal 120, while the inner ring 143B is fixed to a lower portion of the support post 106 and the outer ring 145B is fixed to a lower portion of the pedestal 120. In the embodiment shown, the outer ring 145 also includes a flange 146 (or large diameter portion). The flange 146A of the first bearing unit 142 is structurally fastened to the top surface of the pedestal 120 and the flange 146B of the second bearing unit 144 is structurally fastened to the bottom surface of the pedestal 120. One particular advantage of this bearing arrangement is that a smooth rotation results in which vibrations and wear are substantially reduced. That is, by placing the bearings on the lower part (e.g., support post 106) of the shaft 84 and closer to the base 82, the wobbling associated with an un-balanced rotor is substantially reduced.

In one embodiment, predetermined portions of the bearing units are formed from a phenolic material (laminate plastic). By way of example, the bearings and/or the surfaces (e.g., inner and outer rings) in which the bearings are disposed may be formed from a phenolic material. Phenolic bearing units are light weight and provide good mechanical strength, dimensional stability, low moisture absorption, and resistance to corrosion and chemicals. In addition, phenolic bearing units are heat and wear resistant. It has been found that phenolic bearing units capability yields 100,000 revolutions per minute without bum out (manufacturers specifications). Accordingly, phenolic bearing units are a good fit for video recording applications that run at high RPMs (e.g., 10,000) and for extended amounts of time (e.g., heat). Moreover, the bearings may be vacuum Tubed. By way of example, phenolic bearings manufactured by New Hampshire Bearings of New Hampshire may be used.

Although the bearing assembly is shown and described as having two sets of bearing units, it should be appreciated that a single bearing unit or more than two bearing units may be used. For example, a single bearing unit may extending from the top surface of the pedestal to the bottom surface of the housing.

Figure 6:
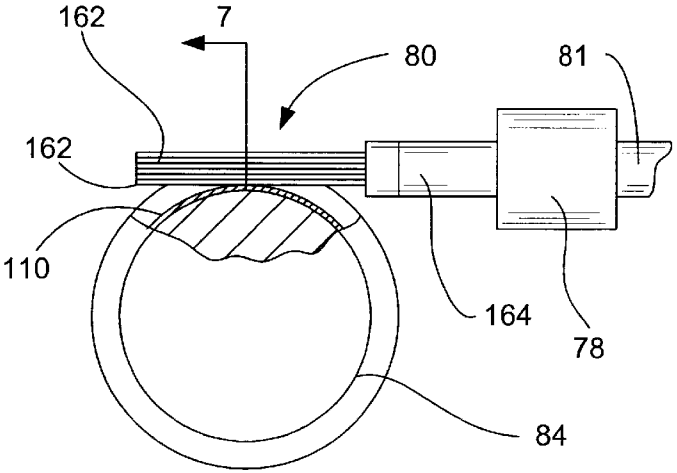
FIG. 6 shows a fiber brush in tangential contact with a slip ring, in accordance with one embodiment of the present invention.
Figure 5:
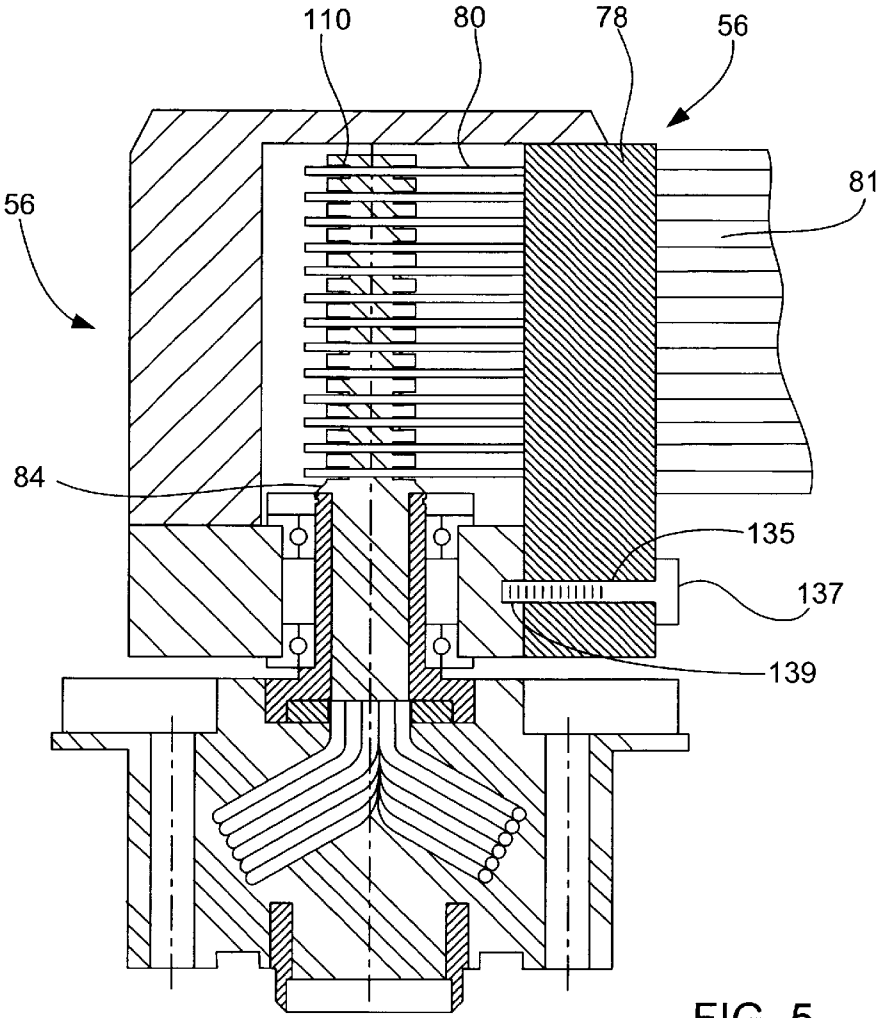
FIG. 5 is a side elevation view, in cross section of a slip ring and brush assembly, in accordance with one embodiment of the present invention.

Referring now to FIGS. 5–7, the brush assembly 56 will be described in greater detail. As mentioned, the brush assembly 56 includes a brush holder 78 and plurality of brushes 80 that are configured to couple with the slip ring assembly 56. The brush holder 78 is configured to structurally couple with the pedestal 120 by means of a bolt or screw. As shown, the brush holder 78 includes a passage 135 for a bolt 137 to pass through and the pedestal 120 includes a threaded portion 139 for securely receiving the bolt 137. The plurality of brushes 80, on the other hand, are configured to electrically couple with the plurality of slip rings 110, which are positioned on the shaft 84.

Each of the brushes 80 are electrically isolated from one another and vertically stacked along the brush holder 78. In the embodiment shown, the brushes 80 are stacked similarly to the slip rings 110 so that individual ones of the brushes 80 contact individual ones of the slip rings 110. As such, the brushes 80 provide an electric path from the slip rings 110 to the transport cable 81. In accordance with one embodiment of the invention, 13 brushes are used to transmit electrical signals and power to and from 13 slip rings.

In a preferred embodiment, the brushes 80 comprise a plurality of filaments 162, which are held in a unitary relationship by means of a collar 164 located at a point spaced away from the fiber ends. By way of example, representative fiber brushes utilizing a plurality of filaments are described in the U.S. Pat. No. 4,398,113 to Lewis et al., which is herein incorporated by reference. The filaments 164 may be formed from a suitable conductive material such as metal. By way of example, copper, beryllium copper, nickel and phosphor bronze may be used. Furthermore, the diameter of the filaments are generally between about 1 to about 3 mils. As should be appreciated, the size may vary according to the specific material chosen. Also, it should be noted that the aforementioned sizes and materials are not a limitation and that they may vary according to the specific needs of each assembly. In the embodiment shown, 10 filaments are bundled together. It should be understood, however, that this is not a limitation and that the number of fibers may vary according to the specific needs of each device. By way of example, anywhere from 2 to about 10,000 fibers may be used.

Furthermore, the collar 164 is generally designed to hold fibers 162 in a selectively shaped bundle. As shown in FIG. 6, the fibers 162 extend from the collar 164 a sufficient distance to enable them to be tangential contact with the slip ring 110, and are held in position by the brush holder 78. In an alternate embodiment, the plurality of filaments may be configured to contact a ring surface so that the ends of the filament are in contact with the slip ring. Such an arrangement provides for a greater number of filaments contacting the slip ring than would otherwise occur if the filaments were tangential to the slip ring.

The multiple fiber brushes offer a number of advantages over single element brushes. For example, the separate fibers create a large number of current carrying spots, thus drastically lowering electrical resistance and increasing current density. The individual brush fibers of the multiple fiber brush are able to adapt to the unevenness of the ring surface because of their elasticity and flexibility (See FIG. 7). The fibers in actual contact with the ring are biased by other fibers, which comprise the brush. These properties also greatly reduce brush bounce caused when the brush hits a high spot on the ring surface at high ring speed. The fact that brush bounce is greatly reduced and the fact that the need for lubrication is minimized because of the very low forces between contact members permit the fiber brush contact system to be operated in conjunction with very high ring speeds and for long periods of time.

While this invention has been described in terms of several preferred embodiments, there are alterations, permutations, and equivalents, which fall within the scope of this invention. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed is:

1. A slip ring assembly for use in a video recording device comprising:

a base for coupling with a rotatable spindle located in a drum assembly of a video tape recorder, the base including a plurality of electrically conductive contact pads for electrically engaging a plurality of electrically conductive leads disposed on the rotatable spindle and electrically coupled to a record/reproduce head assembly;

a shaft having a first portion coupled to the base and a second portion extending longitudinally from the first portion;

a plurality of electrically conductive slip rings positioned on the second portion of the shaft, each slip ring being separated by an insulating medium and electrically coupled to an individual one of the plurality of contact pads; and a pedestal rotatably supported on the first portion of the shaft.

2. The slip ring assembly as recited in claim 1 wherein the plurality of contact pads are formed from solid gold.

3. The slip ring assembly as recited in claim 1 wherein the plurality of contact pads are circular.

4. The slip ring assembly as recited in claim 1 wherein the plurality of contact pads are disposed on a bottom surface of the base and balanced so as to substantially reduce vibration of the base during rotation.

5. The slip ring assembly as recited in claim 1 wherein the plurality of contact pads include a dummy pad for balancing the base so as to substantially reduce vibration of the base during rotation.

6. The slip ring assembly as recited in claim 1 wherein the base includes an extended neck configured to provide concentric support between the base and the rotatable spindle when the base is coupled to the rotatable spindle.

7. The slip ring assembly as recited in claim 6 wherein the extended neck has a length greater than or equal to ⅛ inches.

8. The slip ring assembly as recited in claim 6 wherein the extended neck includes a taper for guiding the extended neck into a guide disposed on the rotating spindle.

9. The slip ring assembly as recited in claim 1 wherein the plurality of slip rings are formed from solid gold.

10. The slip ring assembly as recited in claim 1 wherein the first portion structurally supports the second portion, and wherein the second portion includes a plurality of circumferential ridges and a plurality of circumferential grooves, each of the circumferential grooves being configured to securely receive an individual one of the plurality of slip rings, and each of the circumferential ridges being configured to electrically separate the individual ones of the plurality of slip rings.

11. The slip ring assembly as recited in claim 1 wherein a bearing assembly is used to rotatably support the pedestal on the first portion of the shaft.

12. The slip ring assembly as recited in claim 11 wherein the bearing assembly includes a first bearing unit coupled to an upper portion of the pedestal and a second bearing unit coupled to a lower portion of the pedestal.

13. The slip ring assembly as recited in claim 11 wherein the bearing assembly includes portions formed from a phenolic material.

14. The slip ring assembly as recited in claim 1 further including a sheath structurally coupled to the pedestal and surrounding the shaft, the sheath having a cavity configured to enclose the shaft within an interior portion of the sheath and a top surface of the pedestal such that the shaft is left unexposed.

15. The slip ring assembly as recited in claim 14 wherein the sheath includes an opening for receiving a brush assembly, the brush assembly having a plurality of individual brushes for contacting individual ones of the plurality of slip rings when the brush assembly is received by the sheath, the cavity of the sheath enclosing the shaft and the brushes within an the interior portion of the sheath, the top surface of the pedestal and an interior surface of the brush assembly such that the shaft and the brushes are left unexposed.

16. The slip ring assembly as recited in claim 1 further including a brush assembly for transmitting electrical energy between a plurality of stationary conductors and the plurality of slip rings.

17. The slip ring assembly as recited in claim 16 wherein the brush assembly comprises a plurality of fiber brushes in electrical contact with the plurality of slip rings, and a brush holder for maintaining each of the fiber brushes in contact with individual ones of the plurality of slip rings, each fiber brush including a plurality of fibers that are maintained in a bundle.

18. The slip ring assembly as recited in claim 17 wherein the fiber brushes include 10 fibers having a diameter between about 1 to about 3 mils.

19. The slip ring assembly as recited in claim 17 wherein the slip ring assembly includes 13 contact pads and 13 slip rings that are vertically stacked, wherein individual ones of the slip rings are electrically coupled to individual ones of the contact pads, and wherein the brush assembly includes 13 fiber brushes that are vertically stacked, wherein individual ones of the 13 fiber brushes are in contact with individual ones of 13 slip rings.

20. The slip ring assembly as recited in claim 1 wherein the pedestal is rotatably supported on only the first portion of the shaft so as to substantially reduce the effects of rotor vibration.

21. A slip ring and brush assembly for transmitting electrical energy between a stationary conductor and a rotating head assembly of a video recording device comprising:

a rotor including a base and a shaft, the base being arranged to couple with a rotatable spindle located in a drum assembly of a video tape recorder, the base including a conductive contact pad for electrically engaging a plurality of electrically conductive leads disposed on the rotatable spindle and electrically coupled to the rotating head assembly, the shaft extending from the base and including an electrically conductive slip ring positioned on the shaft, the electrically conductive slip ring being electrically coupled to the electrically conductive contact pad;

a stator rotatably coupled to the rotor, the stator including a pedestal and a sheath;

a brush holder mounted to the pedestal, the brush holder being configured to hold a fiber brush in biased contact with the slip ring, the fiber brush being electrically coupled to the stationary conductor, the fiber brush including a plurality of electrically conductive fibers that are grouped together to form a single fiber brush.

* * * * *